US005390913A

United States Patent [19]

Kepler

[11] Patent Number: 5,390,913

[45] Date of Patent: Feb. 21, 1995

[54] BASKETBALL GAME WITH WATER SPRAY SYSTEM

[75] Inventor: Jack Kepler, Eastpointe, Mich.

[73] Assignee: Spray Shot, Inc., Madison Heights, Mich.

[21] Appl. No.: 259,326

[22] Filed: Jun. 13, 1994

[51] Int. Cl.[6] ..... A63B 63/08; A63B 71/02

[52] U.S. Cl. ..... 273/1.5 R; 273/384; 472/92

[58] Field of Search ..... 273/1.5 R, 1.5 A, 384; 472/92-94

[56] References Cited

U.S. PATENT DOCUMENTS

| | | | |
|---|---|---|---|
| 2,148,438 | 2/1939 | Crain et al. | 273/384 |
| 3,201,126 | 8/1965 | Nissen | 273/1.5 X |
| 3,388,909 | 6/1968 | Woods | 273/1.5 R |
| 3,582,078 | 6/1971 | Katras et al. | 273/411 |
| 3,843,127 | 10/1974 | Lack | 273/349 |
| 3,971,562 | 7/1976 | Peterson . | |
| 3,980,304 | 9/1976 | O'Neill et al. | 472/94 X |
| 4,040,622 | 8/1977 | Sinnott | 273/86 R |
| 4,093,228 | 6/1978 | Pierce | 273/384 |
| 4,526,366 | 7/1985 | Kenoon | 273/349 X |
| 4,546,973 | 10/1985 | Mouser | 273/1.5 R |
| 4,715,598 | 12/1987 | Knight | 272/3 |
| 4,956,775 | 9/1990 | Klamer et al. | 273/1.5 A X |
| 5,011,161 | 4/1991 | Galphin | 273/349 |
| 5,064,195 | 11/1991 | McMahan et al. | 275/374 |
| 5,087,054 | 2/1992 | O'Neil | 273/384 |
| 5,120,053 | 6/1992 | Head et al. | 273/1.5 R |
| 5,192,080 | 3/1993 | Duncan | 273/412 |
| 5,316,290 | 5/1994 | Parr et al. | 273/1.5 R |

FOREIGN PATENT DOCUMENTS

| | | | |
|---|---|---|---|
| 528725 | 2/1993 | European Pat. Off. | 472/93 |

OTHER PUBLICATIONS

Recreation Management, Jun. 7, 1974 p. 32.

*Primary Examiner*—Paul E. Shapiro

*Attorney, Agent, or Firm*—Remy J. VanOphem; John VanOphem

[57] ABSTRACT

A sport facility and equipment for playing a game with a ball, in which the overall physical conditions of the game are similar to basketball. The facility is configured to use a basketball or a ball of similar size, in which the object of the game is to throw the ball through a hoop and thereby score a goal. The facility and equipment further include a system for penalizing the performance of a player or team in a manner which encourages the competitiveness of the game and the enjoyment by spectators. Specifically, a system is used to keep track of scores made by one or more participants playing in one or more playing areas. Using preselected criteria, the losing team is doused with a spray of water at the completion of a game.

18 Claims, 4 Drawing Sheets

BASKETBALL GAME WITH WATER SPRAY SYSTEM

BACKGROUND OF THE INVENTION

1. FIELD OF THE INVENTION

The present invention generally relates to amusement equipment, such as facilities for games and other competitive activities. More specifically, this invention relates to a facility and its related equipment for playing a game in which participants play a form of basketball, but are subject to being sprayed with water under certain circumstances.

2. DESCRIPTION OF THE PRIOR ART

The game of basketball has achieved international appeal as a highly competitive, action-oriented activity which can be played for fun or for serious competition. As with most widely enjoyed sports, basketball is both enjoyable to play as a participant, as well as observe as a spectator. Therefore, key influences on the play of the game not only include the skill and enthusiasm of the players, but the enthusiasm of the spectators and their influence on the players.

Due to its wide appeal, the game of basketball has been adapted for modified play under diverse conditions using various types of equipment. For example, U.S. Pat. No. 4,546,973 to Mouser discloses a basketball backboard and support which is adapted to be mounted and used within a racquetball or handball court. While such a device increases the number of locations in which basketball can be played, there is minimal impact on the overall play of the players due to the limited number of spectators who can view a game conducted in a racquetball court.

Another example is disclosed in U.S. Pat. No. 5,064,195 to McMahan et al., which teaches a sound-generating device intended to signal when a basket has been scored. By incorporating a sound-generating device, feedback is provided to the player or players, which enhances the enjoyment of the game and provides additional motivation for scoring goals.

As taught by U.S. Pat. No. 3,582,078 to Katras, the game of basketball can also be combined with other activities to add diversity to the game. Katras teaches a hoop adapted to be suspended over a pool to allow a modified version of basketball to be played as a water sport. Playing the game in water alters the conditions under which the game is played, and can add to the enjoyment of the game, but does not affect the overall competitive aspect of the game.

From the above discussion, it can be readily appreciated that the above prior art generally is directed to the conditions and equipment with which a version of basketball is played, but does not significantly affect the competitiveness inherent with the game of basketball. Accordingly, it would be desirable if a sport facility was available by which a basketball-related game could be played, in which the facility was adapted to generate a positive and significant impact on the competitiveness of the game. It would also be desirable if such a facility were appropriate for viewing by numerous spectators, such as at an amusement park. Furthermore, it would be desirable if such a facility could enhance the enjoyment of the game's spectators, such that the overall competitiveness of the game is further enhanced by the response and enthusiasm of the crowd.

SUMMARY OF THE INVENTION

According to the present invention, there is provided a sport facility and equipment for playing a game with a ball, in which the overall physical conditions of the game are similar to basketball. In other words, the game involves the use of a basketball or a ball of similar size and weight, in which the object of the game is to throw the ball through a hoop and thereby score a goal. However, the facility and equipment further include a system for penalizing the performance of a player or team in a manner which encourages the competitiveness of the game and the enjoyment by spectators. Specifically, an automated system is used to keep track of scores made by one or more participants playing in one or more playing areas. Using preselected criteria, the losing team can be doused with a spray of water at the conclusion of a game.

The facility and equipment of this invention generally include a playing area defined by a playing surface and a periphery. An annular-shaped goal, such as a regulation basketball rim attached to a backboard, is supported above the playing surface, while one or more suitable spraying devices are mounted along at least a portion of the periphery of the playing area for selectively spraying water into the playing area. A sensing device is also included, and is used for detecting when the ball passes through the goal. Finally, a control system which communicates with the sensing and spraying devices is used to initiate the flow of water through the spraying devices so as to produce a water spray into the playing area. As such, upon receiving an appropriate signal from the sensing device, the control system serves to initiate the water spray for the purpose of penalizing one or more of the players standing in the playing area.

In a preferred embodiment, the sport facility is dividing into multiple playing areas, for example, two juxtaposed playing areas having corresponding goals positioned at adjacent ends of the juxtaposed playing areas. As such, the control system and spraying devices can be adapted to selectively spray water into only one of the playing areas upon a certain point of play being reached, whether based on time or the number of goals made. Numerous playing areas can be set up such that the participants are all competing against each other, or between selected groups. The sport facility can be established as a permanent facility with a paved or concrete playing surface. Alternatively, the facility can be configured to be supported on a mobile platform to enable the facility to be transported.

According to a preferred aspect of this invention, the sport facility enhances the competitiveness of a game of basketball due to the loser of the game being penalized at the conclusion of the game. In a game where the end comes after a certain number of goals are made, the spray of water can occur quite unexpectedly, with tension continuing to increase as time passes and each player is aware that the end of the game is drawing near. The water spray serves as a way of punishing the loser, but in a manner that can be enjoyed by all participants, both winners and losers alike. The water spray can also be particularly refreshing if the game is played outdoors on a hot day.

In addition, a significant advantage of the present invention is that additional enjoyment is also present for spectators. With heightened enthusiasm of a crowd, the enjoyment of playing the game increases for the players as well. Overall, the sport facility of this invention offers an appealing activity that is suitable for use at amusement parks, and combines the competitive appeal of basketball with the refreshment and appeal of recreational water sports.

Accordingly, it is an object of the present invention to provide a sport facility which combines the play of basketball with certain aspects of a recreational water sport.

It is a further object of the invention that the sport facility allow for one or more participants to compete in a manner which penalizes at least some of the participants with a spray of water at the conclusion of a game.

It is still a further object of the invention that the sport facility include a system for keeping track of scoring, such that penalties are allocated by the number of scores made.

It is another object of the invention that the sport facility be adapted for allowing competition between players.

Other objects and advantages of this invention will be more apparent after a reading of the following detailed description taken in conjunction with the drawings provided.

DETAILED DESCRIPTION OF THE PREFERRED EMBODIMENT

Figure 1:
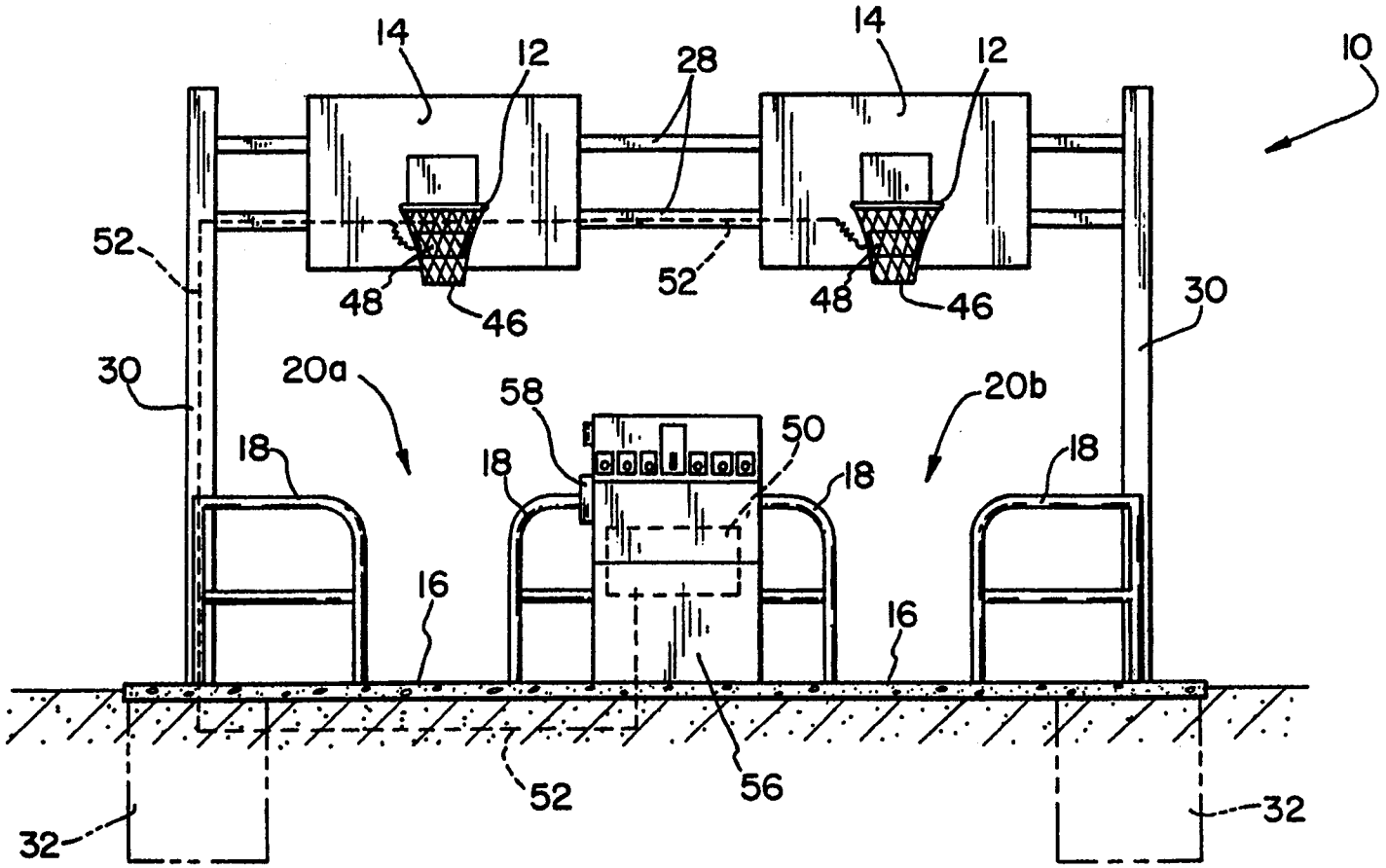
FIG. 1 is a front view of a sport facility in accordance with a first embodiment of this invention.
Figure 2:
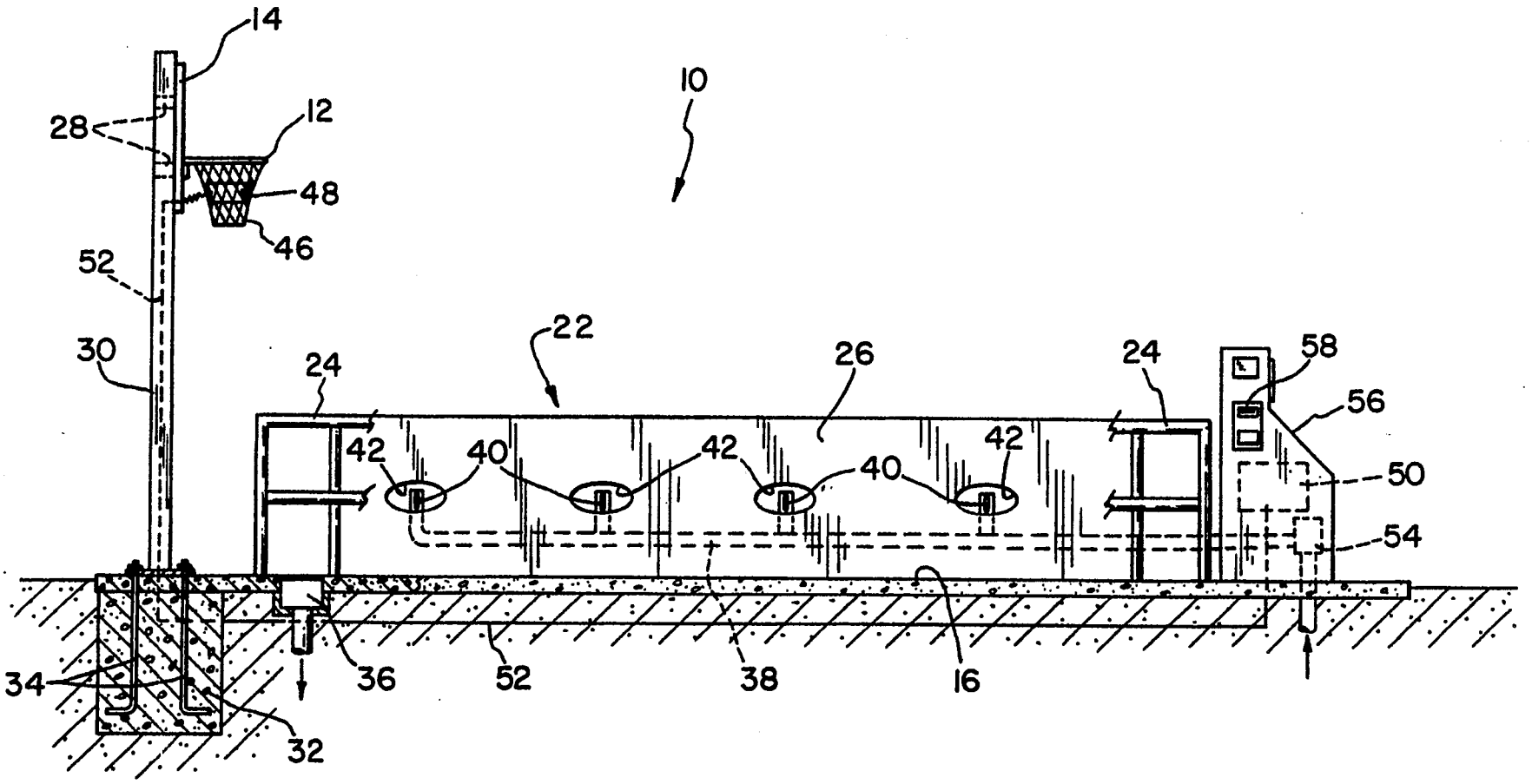
FIG. 2 is a side view of the sport facility of FIG. 1.
Figure 3:
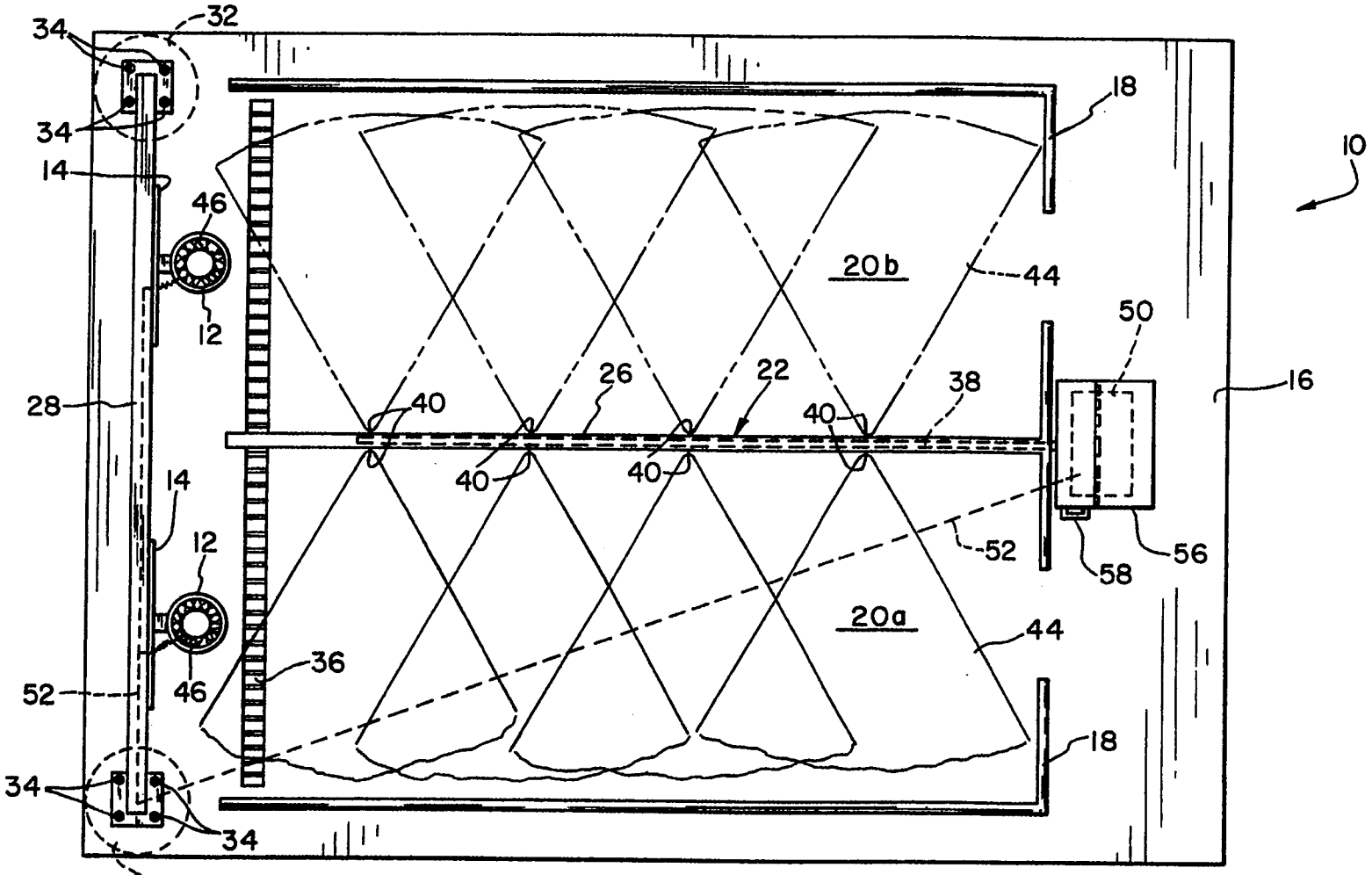
FIG. 3 is a plan view of the sport facility of FIG. 1.

With reference to FIGS. 1 through 3, there are shown front, side and plan views of a sport facility 10 in accordance with a first embodiment of this invention. As illustrated, the sport facility 10 is equipped with a pair of regulation basketball rims 12 and backboards 14 for playing a modified version of basketball. However, the benefits and competitive enjoyment of the game made possible by the sport facility 10 of this invention could be realized with rims and backboards other than those shown, in order to accommodate young children and other conditions which might affect the ability of individuals to participate and use the sport facility 10.

The sport facility 10 includes a playing area which is generally defined by a playing surface 16. If the sport facility 10 is intended to be a permanent installation, the playing surface 16 can be formed with asphalt, concrete or any other suitably hard and durable material. Alternatively, the sport facility 10 can be configured to be supported on a mobile platform to enable the sport facility 10 to be transported, as represented by a second embodiment of this invention shown in FIG. 4. Because the sport facility 10 incorporates water into the activities in the playing area, the playing surface 16 preferably has a slight incline to ensure the proper drainage of water. Furthermore, as most readily seen in FIG. 2, a drain 36 is provided through which water can escape from the playing area. As illustrated in FIGS. 1 through 3, the playing area is composed of two juxtaposed courts 20*a* and 20*b* on which two individuals or teams can compete against each other. However, it is foreseeable that a single court or more than two courts could be provided within the same sport facility 10 to allow an individual or team to compete against a clock, or to allow simultaneous competition among several individuals or teams.

The outer periphery of the playing area can be delineated by any suitable structure, such as the rails 18 shown, though other structures could be used, including a mesh which assists in keeping a ball in play within the playing area. The shape and size of the playing area are generally unimportant, and can be adapted to suit the particular needs of the circumstances. With the two court version shown in the figures, the sport facility 10 has a rectangular shape which is partitioned with a center divider 22. As shown in FIG. 2, the center divider 22 is composed of a center railing 24 over which a protective padding 26 is placed. The protective padding 26 can be formed of any suitable material, such as a lightweight rigid foam polyvinyl chloride. Enclosed within the protective padding 26 and supported by the center railing 24 is a water spray system, composed of a supply line 38 which receives water under pressure from a suitable source (not shown). The supply line 38 supplies pressurized water to a number of spray heads 40 mounted within apertures 42 formed in the protective padding 26. Each spray head 40 may include a pair of nozzles, each of which points to a different court 20*a* or 20*b* and is supplied with its own supply line 38. Alternatively, a single nozzle could be used, and selectively pointed with a motor (not shown) toward either court 20*a* or 20*b* , depending on the circumstances. The number and type of spray heads 40 may vary, but each with the preferred result of forming spray patterns 44 which cover essentially the entire playing surface 16, as illustrated in FIG. 3. This can be achieved with spray heads 40 which broadcast a spray of water in an arcuate horizontal band, or with spray heads which oscillate and emit water in a more compact stream.

In accordance with the two court configuration shown in the figures, a backboard 14 and rim 12 are provided in each court 20*a* and 20*b*. Each rim 12 is conventionally provided with a net 46. As noted above, the backboards 14 and rims 12 can be sized and positioned at a height of ten feet above the playing surface 16 in accordance with basketball regulations. The backboards 14 and rims 12 are supported at adjacent ends of each court 20*a* and 20*b* above the playing surface 16 by a pair of cross arms 28 mounted to a pair of uprights 30. In order to provide proper support for the uprights 30, a concrete base 32 is preferably provided for each upright 30, as would be conventional for such purposes. Preferably, anchor bolts 34 are embedded in each concrete base 32 to which the base of the uprights 30 can be secured.

Provided with each net 46 is a sensor 48 which is capable of detecting when a ball passes through the rim 12. The sensor 48 is shown schematically in the figures as a band which encircles the net 46. The type of sensor 48 is generally unimportant, as long as a suitable signal can be generated each time a goal is scored. Motion sensors of the type known to those skilled in the art provide a relatively low cost sensing unit, and can provide a suitable output at low operating voltages. However, it is entirely foreseeable that other types of sensors and transducers could also be adapted by one skilled in the art to record goals scored during the use of the sport facility 10 of this invention.

Finally, a control system 50 is provided which communicates with the sensor 48 and regulates the flow of water through the supply line 38 and is used to initiate the flow of water through the spray heads 40. The control system 50 is preferably programmable in order to allow the type and duration of play to be altered as desired. A suitable unit for such purposes is an SLC500 series programmer available from Allen Bradley, though numerous other programmers could be used. The control system 50 communicates with the sensor 48 through appropriate wiring 52 which, as shown, is preferably concealed below the playing surface 16 and within the uprights 30 and cross arms 28. Control of flow to the spray heads 40 can be achieved with a solenoid, represented schematically by reference number 54. The control system 50 and the solenoid 54 are both preferably enclosed within a suitable enclosure 56. Because the sport facility 10 of this invention is particularly ideal for use on a play-for-pay basis, a vending unit 58 can also be installed within the enclosure 56.

In use, the control system 50 is programmed to initiate the flow of water to the spray heads 40 upon receiving an appropriate signal, or an appropriate number of signals, from the sensor 48. For example, the control system 50 can be programmed to penalize one or more players in one of the courts 20*a* and 20*b* by spraying the court 20*a* or 20*b* with the lower score when a predetermined number of goals are scored in the higher scoring court 20*a* or 20*b*. For instance, if the player or players on court 20*a* have scored three goals before the player or players on court 20*b*, the control system 50 can direct flow to the spray heads 40 pointed at the court 20*b* to deliver a spray of water in accordance with the spray patterns 44 shown in FIG. 3. Alternatively, both courts 20*a* and 20*b* can be subjected to a water spray if a predetermined number of goals are not scored in an allotted period of time. Obviously, various other criteria can be used to determine when and which court 20*a* or 20*b* is to be subjected to the water spray.

Figure 4:
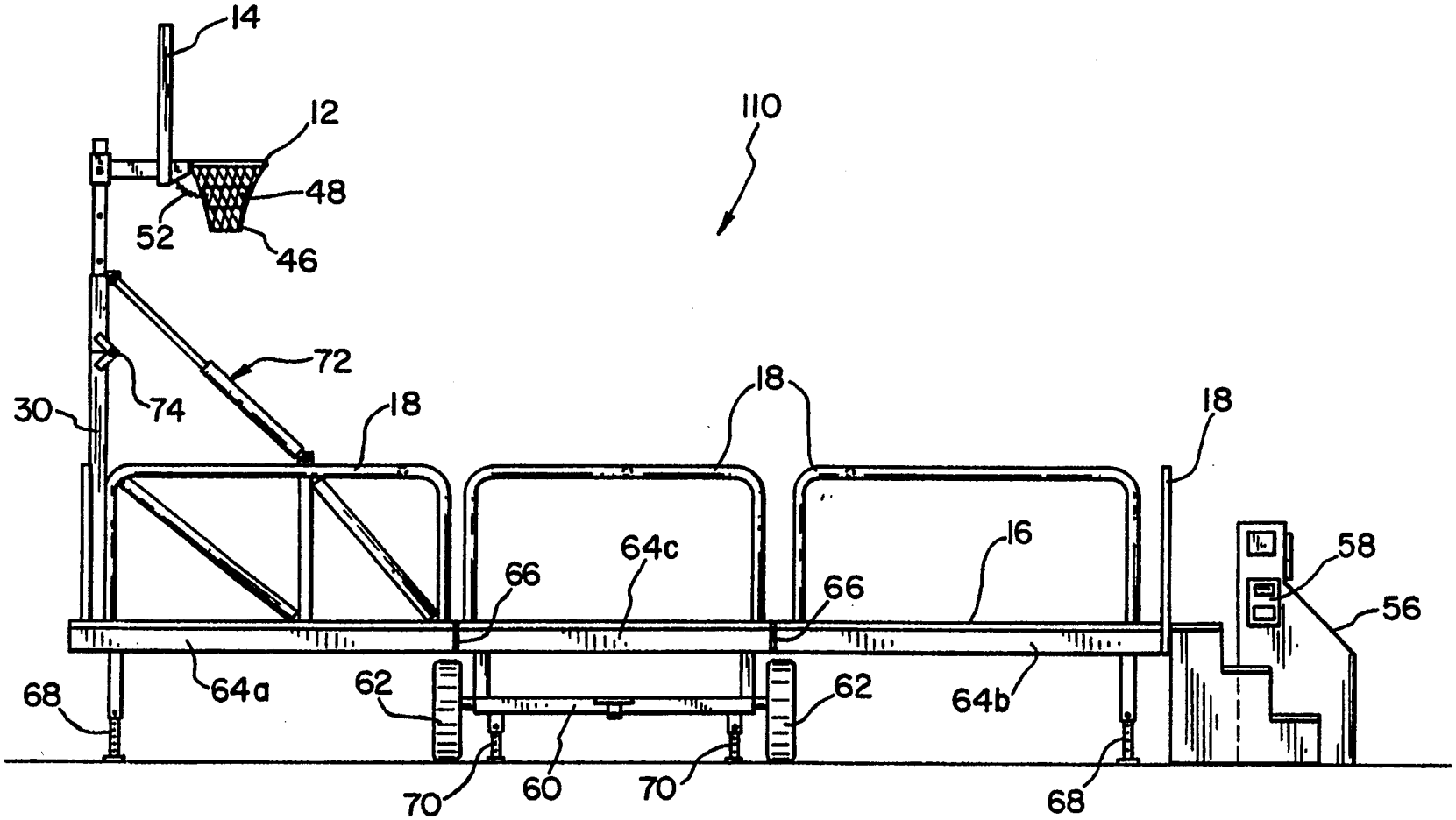
FIG. 4 is a side view of a portable sport facility in accordance with a second embodiment of this invention.

FIG. 4 illustrates a variation of the sport facility 10 shown in FIGS. 1 through 3. Essentially, FIG. 4 shows a sport facility 110 which can be operated in an identical manner to that shown in FIGS. 1 through 3, but utilizes a mobile platform to allow the sport facility 110 to be relocated as desired. For clarity, the same reference numbers cited in FIGS. 1 through 3 are repeated here for the same components.

As shown, the sport facility 110 is supported on a chassis 60 equipped with wheels 62. The sport facility 110 generally is configured to have a pair of wing units 64*a* and 64*b* which can be folded over a central unit 64*c* located directly over the chassis 60. The wing units 64*a* and 64*b* are attached to the central unit 64*c* at a corresponding pair of hinged joints 66. When fully expanded to permit play, the wing units 64*a* and 64*b* are preferably supported above the ground with adjustable jacks 68, as shown. Additional jacks 70 can also be placed beneath the chassis 60 to provide additional support and stability to the sport facility 110. To provide additional support and stability to the uprights 30 supporting the rim 12 and backboard 14, a brace 72 preferably interconnects the uprights 30 with the railing 18. In a preferred embodiment, the brace 72 is a cylinder which allows the uprights 30 to be rotated about a joint 74 and retracted over the playing surface 16 to facilitate transport of the sport facility 110. Again, this embodiment is intended to enhance versatility, and need not affect the play of the game.

From the above, it can be seen that a significant advantage of the sport facilities 10 and 110 of the present invention is that the competitiveness of a game of basketball is increased due to the potential for one player or group of players to be penalized at the conclusion of the game. For a basketball game which ends upon a certain number of goals being scored, the spray of water can occur quite unexpectedly, though tension continues to increase as time passes and each player is aware that the end of the game is drawing near. Though the water spray serves as a way of punishing the loser, it does so in a manner that can be enjoyed by all participants, both winners and losers alike. As with other recreational water activities, the water spray can also be particularly refreshing if played outdoors on a hot day.

Another significant advantage of the present invention is that additional enjoyment is also created for spectators of the game. With heightened enthusiasm of a crowd, the enjoyment of playing the game increases for the players as well. Overall, the sport facilities 10 and 110 of this invention offer an appealing activity that is suitable for amusement parks, and combines the competitive appeal of basketball with the refreshment and appeal of a recreational water sport.

In addition, the advantages of the sports facilities 10 and 110 can be realized by equipping a pre-existing basketball court with the sensor 48, spray system and control system 50 of this invention. Accordingly, this invention can potentially be installed at numerous locations without necessitating an investment in a court, backboard and rim.

In summary, the present invention provides a sport facility for playing a modified version of basketball, in which a system is included for penalizing the performance of a player or team in a manner which encourages the competitiveness of the game and the enjoyment by spectators. This combination can have minimal effect on the conditions and equipment with which a basketball game is played, while significantly affecting the competitiveness inherent with the game of basketball. The sport facilities 10 and 110 of this invention promote a positive and significant impact on the competitiveness of the game, allow viewing by numerous spectators, such as at an amusement park, and enhance the enjoyment of the game's spectators, such that the overall competitiveness of the game is further enhanced by the response and enthusiasm of the crowd.

While the invention has been described in terms of a preferred embodiment, it is apparent that other forms could be adopted by one skilled in the art. For example, the geometry of the playing area could differ substantially from the rectangular-shaped area shown in the figures, the physical structure of the sport facilities 10 and 110 could be modified considerably, and various components and equipment could be used to modify or supplement those described from the sensing, control and water spray systems. Accordingly, the scope of the invention is to be limited only by the following claims.

What is claimed is:

1. A sport facility sized to accommodate at least one player playing a game with a ball, said sport facility comprising:

a playing area defined by a playing surface and a periphery;

spraying means located at said periphery of said playing area for selectively spraying water into said playing area;

a goal supported above said playing surface, said goal being sized to permit said ball to pass therethrough;

sensing means associated with said goal for detecting when said ball passes through said goal; and control means in communication with said sensing means and said spraying means for initiating flow of water through said spraying means so as to produce a water spray into said playing area;

whereby said control means initiates said water spray into said playing area upon receiving a signal from said sensing means.

2. The sport facility of claim 1 further comprising a divider which divides said playing area into multiple playing areas.

3. The sport facility of claim 2 wherein said goal and said sensing means are positioned for use with a first playing area of said multiple playing areas, and wherein said sport facility further comprises:

a second goal supported above said playing surface for a second playing area of said multiple playing areas, said second goal being sized to permit said ball to pass therethrough; and second sensing means associated with said second goal for detecting when said ball passes through said second goal, said control means being in communication with said second sensing means and said spraying means for initiating flow of water through said spraying means so as to produce a water spray into said second playing area.

4. The sport facility of claim 2 wherein said spraying means comprises a first unit for use with a first playing area of said multiple playing areas, and a second unit for use with a second playing area of said multiple playing areas.

5. The sport facility of claim 2 wherein said spraying means comprises multiple spray nozzles located along at least a portion of said periphery of said playing area.

6. The sport facility of claim 2 wherein said playing surface is a permanent playing surface.

7. The sport facility of claim 2 further comprising a chassis on which said sport facility is supported, said chassis being adapted to transport said sport facility.

8. A sport facility sized to accommodate at least two players which are simultaneously playing a game in which said at least two players are equipped with at least two balls, said sport facility comprising:

a playing area;

a divider placed in said playing area so as to divide said playing area into multiple playing areas, each of said multiple playing areas having a playing surface and a periphery;

spraying means located at said periphery of each of said multiple playing areas for selectively spraying water into said multiple playing areas;

an annular-shaped goal supported above each of said playing surfaces, said annular-shaped goal being sized to permit one of said at least two balls to pass therethrough;

sensing means associated with each of said annular-shaped goals for detecting when one of said at least two balls passes through said annular-shaped goals; and control means in communication with said sensing means and said spraying means for initiating flow of water through said spraying means so as to produce a water spray into at least one of said multiple playing areas;

whereby said control means initiates said water spray into said at least one of said multiple playing areas upon receiving a signal from said sensing means.

9. The sport facility of claim 8 wherein said divider divides said playing area into first and second juxtaposed playing areas.

10. The sport facility of claim 8 wherein said spraying means comprises a first unit for use with a first playing area of said multiple playing areas, and a second unit for use with a second playing area of said multiple playing areas.

11. The sport facility of claim 8 wherein said spraying means comprises multiple spray nozzles located along at least a portion of each said periphery of said multiple playing areas.

12. The sport facility of claim 8 wherein each of said playing surfaces is a permanent playing surface.

13. The sport facility of claim 8 further comprising a chassis on which said sport facility is supported, said chassis being adapted to transport said sport facility.

14. The sport facility of claim 8 wherein said control means initiates said water spray after receiving a predetermined number of said signals from said sensing means.

15. A sport facility sized to accommodate at least two players which are competing against each other by playing a game in which said at least two players are equipped with two basketballs, said sport facility comprising:

a playing area;

a divider placed in said playing area so as to divide said playing area into two juxtaposed playing areas, each of said two juxtaposed playing areas having a playing surface and a periphery;

first spraying means mounted at said periphery of a first playing area of said two juxtaposed playing areas for selectively spraying water into said first playing area, said first spraying means comprising multiple spray nozzles located along at least a portion of said periphery of said first playing area;

second spraying means mounted at said periphery of a second playing area of said two juxtaposed playing areas for selectively spraying water into said second playing area, said second spraying means comprising multiple spray nozzles located along at least a portion of said periphery of said second playing area;

an annular-shaped goal supported above each of said playing surfaces, said annular-shaped goal being sized to permit one of said two basketballs to pass therethrough;

sensing means associated with each of said annular-shaped goals for detecting when one of said two basketballs passes through a corresponding one of said annular-shaped goals; and control means in communication with said sensing means and said first and second spraying means for initiating flow of water through said first and second spraying means so as to produce a water spray into at least one of said two juxtaposed playing areas;

whereby said control means initiates said water spray into said at least one of said two juxtaposed playing areas upon receiving a signal from said sensing means.

16. The sport facility of claim 15 wherein each of said playing surfaces is a permanent playing surface.

17. The sport facility of claim 15 further comprising a chassis on which said sport facility is supported, said chassis being adapted to transport said sport facility.

18. The sport facility of claim 15 wherein said control means initiates said water spray after receiving a predetermined number of said signals from said sensing means.

* * * * *